US005260856A

United States Patent [19]

Perthus et al.

[11] Patent Number: 5,260,856

[45] Date of Patent: Nov. 9, 1993

[54] HEADLAMP FOR MOTOR VEHICLES

[75] Inventors: Peter Perthus; Jürgen Stein, both of Stuttgart; Tilman Spingler, Kohlberg; Friedrich Schmied, Pfullingen; Peter Kusserow, Sonnenbühl, all of Fed. Rep. of Germany

[73] Assignee: Robert Bosch GmbH, Stuttgart, Fed. Rep. of Germany

[21] Appl. No.: 828,811

[22] PCT Filed: May 23, 1991

[86] PCT No.: PCT/DE91/00426

§ 371 Date: Jan. 27, 1992

§ 102(e) Date: Jan. 27, 1992

[87] PCT Pub. No.: WO91/19937

PCT Pub. Date: Dec. 26, 1991

[30] Foreign Application Priority Data

Jun. 20, 1990 [DE] Fed. Rep. of Germany ..... 4019587

[51] Int. Cl.[5] ..... F21M 3/02; F21V 9/06

[52] U.S. Cl. ..... 362/61; 362/296; 362/310; 362/351

[58] Field of Search ..... 362/61, 293, 226, 296, 362/254, 308, 310, 351

[56] References Cited

U.S. PATENT DOCUMENTS

| | | | |
|---|---|---|---|
| 4,935,660 | 6/1990 | Heider et al. | 362/293 |
| 5,107,405 | 3/1992 | Makita | 362/61 |
| 5,113,330 | 5/1992 | Makita | 362/61 |
| 5,130,904 | 7/1992 | Ohshio et al. | 362/293 |
| 5,132,881 | 7/1992 | Wakimizu et al. | 362/61 |
| 5,140,504 | 8/1992 | Sato | 362/61 |

FOREIGN PATENT DOCUMENTS

| | | |
|---|---|---|
| 2854110 | 6/1980 | Fed. Rep. of Germany . |
| 3304036 | 8/1984 | Fed. Rep. of Germany . |
| 8803881 | 6/1988 | Fed. Rep. of Germany . |
| 1583987 | 12/1969 | France . |
| 2158650 | 6/1973 | France . |
| 2652317 | 3/1991 | France . |

*Primary Examiner*—Richard R. Cole
*Attorney, Agent, or Firm*—Michael J. Striker

[57] ABSTRACT

A headlamp for motor vehicles has a reflector, a discharge lamp located in front of the reflector, a glass envelope surrounding the discharge lamp and being transparent in certain sections to light of specific wavelengths, a lamp carrier which holds the discharge lamp so that the discharge lamp is arranged in a space limited at least by the lamp carrier and the glass envelope. The glass envelope blocks UV light in UV-A, UV-B and UV-C wavelength range.

17 Claims, 2 Drawing Sheets

HEADLAMP FOR MOTOR VEHICLES

BACKGROUND OF THE INVENTION

The present invention relates a headlamp for motor vehicles. More particularly, it relates to a headlamp for motor vehicles which has a discharge lamp inserted into a reflector and surrounded by a glass envelope which is transparent in certain sections to light of specific wavelengths.

Such a headlamp is disclosed in EP-A1-0 237 647. This headlamp has a discharge lamp whose discharge vessel is surrounded a glass envelope made of hard glass. The discharge vessel is melt-sealed into the glass envelope so that these parts are combined to form one unit. The space between glass envelope and discharge vessel is evacuated. The glass envelope is provided in certain sections with a coating which is non-transparent and by means of which an asymmetrical light distribution required in dipped headlamps is achieved. By means of the glass envelope, the UV-A light portion and UV-B light portion of the light transmitted by the discharge lamp is blocked to a specific degree since, due to its properties, glass generally inhibits the passage of these portions. However, the UV-C light portion which is injurious to health and also destroys plastics is not blocked by a glass envelope consisting merely of customary glass. In addition, if the glass envelope is touched when the headlamp is damaged, for example after an accident, there is a risk of combustion. The reason is that the high temperatures prevailing in the discharge vessel are transmitted to the glass envelope and if the electrical terminals of the discharge lamp are touched there is a risk of lethal injury since the lamp is operated at a high voltage.

SUMMARY OF THE INVENTION

Accordingly, it is an object of the present invention to provide a headlamp for motor vehicles, which avoids the disadvantages of the prior art.

In keeping with these objects and with others which will become apparent hereinafter, one feature of the present invention resides, briefly stated, in a headlamp for motor vehicles, in which a discharge lamp is held in a lamp carrier and arranged in a space limited at least by the lamp carrier and the glass envelope, wherein the glass envelope blocking UV light in the UV-Am UV-B and UV-C wavelengths range.

When the headlamp for motor vehicle is designed in accordance with the present invention it has, in contrast with the above, the advantage that principally also the UV-C light portion is blocked by the glass envelope and thus there is no risk of injury to health and no risk of destruction of plastic parts. In addition, the risk of combustion is reduced by the glass envelope since the discharge lamp cannot be touched directly but rather only the glass envelope, which reaches a substantially lower temperature than the discharge lamp. The electrical terminals of the discharge lamp are also prevented by the glass envelope from being touched.

In accordance with a further feature of the present invention, electrical conductor tracks are arranged on the outer surface of the glass envelope and are part of an electrical line which is connected to a lamp ballast serving to supply the discharge lamp with high voltage, and the discharge lamp is prevented from operating when the line is interrupted. When the head-lamp is designed in accordance with these features, a further increase in safety is achieved since the discharge lamp cannot be operated with damaged conductor tracks and thus with a damaged glass envelope and also when the glass envelope is not mounted. In accordance with a further feature of the present invention, the headlamp has a shutter with an optically effective edge and a lens is arranged in the direction of the light reflected by the reflector, so that by means of the lens, an image of the edge of the shutter is formed as a light/dark border of the light distribution. The end of the glass envelope pointing in the direction of emergence of light receives the lens, and the lens, like the glass envelope, blocks light in the UV-A, UV-B and UV-C wavelengths range. When the headlamp is designed in accordance with these features, the glass envelope serves at the same time as a holder for the lens. Still another feature of the present invention is that the conductor tracks of the glass envelope are connected to an annular conductor section on the lens when the lens is inserted and are connected to one another via the section. With these features it is achieved that the discharge lamp cannot be operated when the lens is not inserted or is damaged. It is also possible that the reflector is constructed in a crown-like manner, with radially elastic resilient tops, between which the end region of the glass envelope can be clamped. In this case the glass envelope can be easily mounted.

In the further development the cover is designed as a coating applied to the glass envelope and therefore, the glass envelope serves at the same time as a carrier of the cover so that no special component is required for this.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
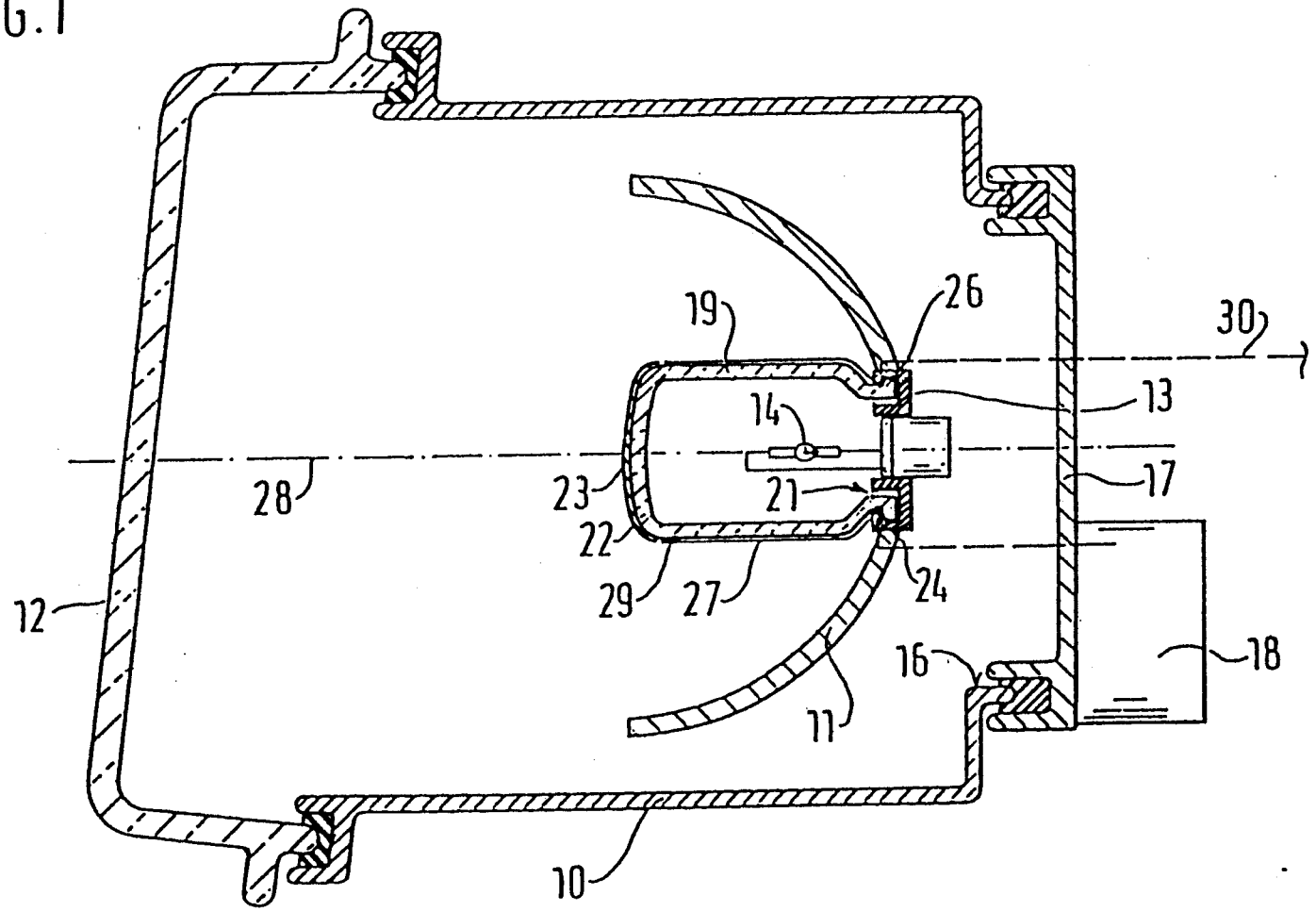
FIG. 1 shows a first exemplary embodiment of a headlamp in a simplified view in longitudinal section.
Figure 2:
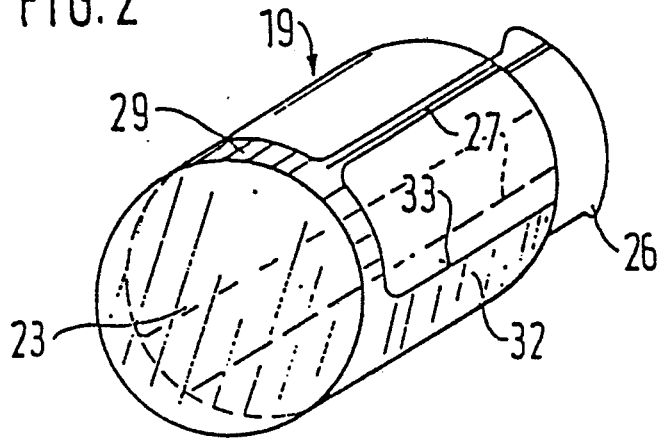
FIG. 2 shows a glass envelope of the headlamp in FIG. 1 in a perspective view and FIG. 3 shows a second exemplary embodiment with a headlamp according to the projection principle in longitudinal section in a greatly simplified view.

A headlamp for motor vehicles illustrated in FIG. 1 with a first exemplary embodiment has a housing 10 made of plastic. A reflector 11 is arranged in the housing. The light exit opening of the housing 10 is covered with a front plate 12. A discharge lamp 14 which is held in a lamp carrier 13 is inserted into the reflector 11 in its apex region and operated at high voltage. The housing 10 has at its rear an opening 16 through which the discharge lamp 14 can be inserted or removed and which can be closed off with a cap 17. The discharge lamp 14 is supplied with the high voltage necessary for its operation from a lamp ballast 18 driven by the electrical system of the motor vehicle. A pot-shaped glass envelope 19 which is held in a receptacle 21 in the lamp carrier 13 is placed, with spacing, over the part of the discharge lamp 14 projecting out of the lamp carrier 13 into the reflector 11. The discharge lamp 14 is thus arranged in a space which is closed off by the lamp carrier 13 and the glass envelope 19. The space between the discharge lamp and the glass envelope is larger than the diameter of the discharge vessel of the discharge lamp. The floor 22 of the glass envelope 19, pointing in the direction of the light emerging from the reflector 11, is provided with a non-transparent coating 23 so that the light emerging directly forward from the discharge lamp 14 is screened. The glass material of the glass envelope 19 or a filter coating applied to the latter blocks in the UV-A, UV-B and UV-C range the UV light transmitted by the discharge lamp 14 so that no damaging UV radiation acts on the housing 10 or emerges from the headlamp.

The receptacle 21 for the glass envelope 19 in the lamp carrier 13 is of crown-like design with resilient tabs 24 arranged with a radial elastic bend on the circumference of said receptacle. The open end of the glass envelope 19 provided with a radially outwardly pointing circumferential projection 26 can be locked in the tabs. However, the glass envelope can also be mounted in the lamp carrier in a different way, for example in a thread-like fashion.

Two conductor tracks 27 are diametrically opposite one another and extend parallel to the longitudinal axis 28 of the glass envelope from its open end to its floor 22. They are arranged on the outer surface of the glass envelope 19. In front of the floor 22, the conductor tracks 27 are connected to one another by means of a conductor section 29 engaging around the circumference of the glass envelope. The conductor tracks 27, 29 are evaporated on the glass envelope 19 and connected in series to the lamp ballast 18 by a feed line from the electrical system of the motor vehicle via contacts in the receptacle 21, and are thus part of the feed line. Only the low voltage of the electrical system is applied to the conductor tracks 27 through this circuit and the discharge lamp 14 can only be operated with the glass envelope 19 inserted and conductor tracks 27, 29 intact. If the glass envelope 19 and thus the conductor tracks 27, 29 are damaged, the feed line to the lamp ballast 18 is interrupted and it is not possible to operate the discharge lamp 14.

The conductor tracks 27, 29 can also be part of a control line which is connected to the lamp ballast 18. The operation of the discharge lamp 14 is prevented by the lamp ballast when the control line 30 is interrupted.

The glass envelope 19 prevents the discharge lamp 14 from being touched during operation. If the conductor tracks 27, 29 on the glass envelope 19 are touched there is no risk of lethal injury, in contrast with the high-voltage terminals of the discharge lamp, which are however prevented from being touched by the glass envelope 19. In addition, the glass envelope 19 acts as a screen against glass pieces of the discharge lamp which are scattered in the event of a possible explosion of the discharge lamp 14 filled with gas under high pressure.

A non-transparent coating 32 which serves to form a light/dark border in the light distribution generated by the headlamp is applied in sections to the glass envelope 19. The coating 32 can be applied on the inner surface or outer surface of the glass envelope 19. The course of the edge 33 of the coating 32 is oriented to the desired course of the light/dark border. In order to avoid an accumulation of heat, the glass envelope 19 can be enlarged in the region of the coating 32.

Figure 3:
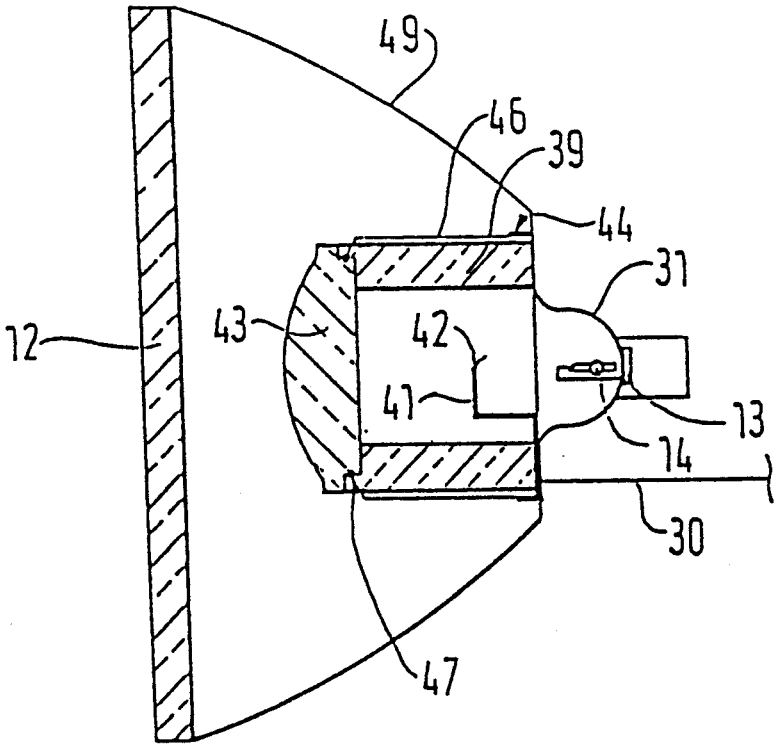

In FIG. 3, a second exemplary embodiment is illustrated with a headlamp according to the projection principle. This headlamp has a reflector 31 in whose horizontal and vertical central section ellipses are produced. The discharge lamp 14 is inserted into the reflector 31 by means of the lamp carrier 13. A shutter 41 with an optically effective upper edge 42 and a lens 43 which forms an image of the upper edge 42 of the shutter 41 as a light/dark border of the light distribution is arranged in the direction of the light reflected by the reflector 31. The discharge lamp 14 is surrounded by a glass envelope 39 which, as described in the first exemplary embodiment, is constructed as a UV filter and which is inserted into a receptacle 44 arranged at the front edge of the reflector 31. The shutter 41 is also held in the receptacle 44 and arranged within the glass envelope 39. The end of the glass envelope 39 pointing in the direction of emergence of light receives the lens 43 and, it is impossible for any UV radiation to emerge between glass envelope 39 and lens 43. The lens 43 is constructed, like the glass envelope 39, as a UV filter. The discharge lamp 14 is thus arranged in a space limited by the lamp carrier 13, the reflector 31 and the glass envelope 39 and the lens 43 and completely screened.

Two electrical conductor tracks 46 which extend parallel to its longitudinal axis from the receptacle 44 to the front end of the glass envelope 39 are arranged on the glass envelope 39 diametrically opposite one another. On the lens 43, an annular conductor section 47 is arranged pointing towards the glass envelope. Thereby the conductor tracks 46 are connected to one another when the lens 43 is inserted into the glass envelope 39. The conductor tracks 46 are connected by means of contacts in the receptacle 44 to the electrical line 30. As described in the first exemplary embodiment, it can be a feed line from the vehicle electrical system or a control line to the lamp ballast 18. The receptacle 44 for the glass envelope 39 can, as described in the first exemplary embodiment, also be constructed in a crown-like manner.

An additional reflector 49 is arranged adjacent to the reflector 31 in the direction of emergence of light. It has no influence on the light distribution and serves to generate a desired apparent image of the headlamp, for example a rectangular or round apparent image.

It will be understood that each of the elements described above, or two or more together, may also find a useful application in other types of constructions differing from the types described above.

While the invention has been illustrated and described as embodied in a headlamp for motor vehicles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A headlamp for motor vehicles, comprising a reflector; a discharge lamp located in front of said reflector; a glass envelope surrounding said discharge lamp and being transparent in certain sections to light of specific wavelengths; a lamp carrier which holds said discharge lamp so that said discharge lamp is arranged in a space limited at least by said lamp carrier and said glass envelope, said glass envelope blocking UV light, in UV-A, UV-B and UV-C wavelength range; a lamp ballast serving to support said discharge lamp with high voltage; electrical line connected said lamp ballast; and electrical conductor tracks arranged on an outer surface of said glass envelope and forming a part of said electrical line, said discharge lamp being prevented from operating when said electrical line is interrupted.

2. A headlamp as defined in claim 1, wherein said electrical line is a part of a feed line from an electrical system of the motor vehicle to said lamp ballast.

3. A headlamp as defined in claim 1, wherein said electrical line is a control line formed so that an operation of said discharge lamp is prevented when said control line is interrupted by said lamp ballast.

4. A headlamp as defined in claim 1, wherein said glass envelope has a pot shape and a floor pointing in direction of emergence of light, said floor being non-transparent, said conductor tracks extending approximately parallel to a longitudinal axis of said glass envelope and being connected to one another in the region of said floor.

5. A headlamp as defined in claim 4; and further comprising an annular conductor section which connects said conductor tracks to one another in the region of said floor.

6. A headlamp as defined in claim 1; and further comprising a non-transparent cover provided on said glass envelope to form a light/dark border in a light distribution generated by the headlamp.

7. A headlamp as defined in claim 6, wherein said cover is formed as a coating applied to said glass envelope.

8. A headlamp as defined in claim 1, wherein said glass envelope has a floor which is non-transparent.

9. A headlamp as defined in claim 1; and further comprising a shutter with an optically effective edge and a lens arranged in direction of the light reflected by said reflector and forms an image of said edge of said shutter as a light/dark border of a light distribution, said glass envelope having an end which points in direction of emergence of light, said end of the glass envelope receiving said lens which blocks light in the UV-A, UV-B and UV-C wavelength range.

10. A headlamp as defined in claim 9, wherein said lens has an annular conductor section, said glass envelope having conductor tracks which are connected to said annular conductor section when said lens is inserted and are connected to one another by said annular conductor section.

11. A headlamp as defined in claim 10, wherein said conductor tracks are formed as evaporate conductor tracks on said glass envelope.

12. A headlamp as defined in claim 10, wherein said annular conductor sections are formed as an evaporated conductor section on said lens.

13. A headlamp as defined in claim 9, wherein said lamp carrier has a receptacle, said glass envelope being inserted in said receptacle.

14. A headlamp as defined in claim 9, wherein said reflector has a front edge provided with a receptacle, said glass envelope being inserted in said receptacle of said front edge of said reflector.

15. A headlamp for motor vehicles, comprising a reflector; a discharge lamp located in front of said reflector; a glass envelope surrounding said discharge lamp and being transparent in certain sections to light of specific wavelengths; a lamp carrier which holds said discharge lamp so that said discharge lamp is arranged in a space limited at least by said lamp carrier and said glass envelope, said glass envelop blocking UV light, in UV-A, UV-B and UV-C wavelength range, said lamp carrier having a receptacle, said glass envelope being inserted in said receptacle; conductor tracks arranged on said glass envelope; and means for making contact with said conductor tracks and arranged in said receptacle.

16. A headlamp for motor vehicles, comprising a reflector; a discharge lamp located in front of said reflector; a glass envelope surrounding said discharge lamp and being transparent in certain sections to light of specific wavelengths; a lamp carrier which holds said discharge lamp so that said discharge lamp is arranged in a space limited at least by said lamp carrier and said glass envelope, said glass envelop blocking UV light, in UV-A, UV-B and UV-C wavelength range, said reflector having a front edge provided with a receptacle, said glass envelope being inserted in said receptacle of said front edge of said reflector; conductor tracks arranged on said glass envelope; and means for making contact with said conductor tracks and arranged in said receptacle.

17. A headlamp for motor vehicles, comprising a reflector; a discharge lamp located in front of said reflector; a glass envelope surrounding said discharge lamp and being transparent in certain sections to light of specific wavelengths; a lamp carrier which holds said discharge lamp so that said discharge lamp is arranged in a space limited at least by said lamp carrier and said glass envelope, said glass envelop blocking UV light, in UV-A, UV-B and UV-C wavelength range; and means forming a crown-like receptacle provided with radially elastic resilient tabs, said glass envelope having an end region which is clamped between said resilient tabs.

* * * * *